US010101013B2

(12) United States Patent
Leung

(10) Patent No.: US 10,101,013 B2
(45) Date of Patent: Oct. 16, 2018

(54) SEASONAL LIGHT STRINGS AND METHOD OF ASSEMBLING SEASONAL LIGHT STRINGS EMPLOYING CAPACITOR SHUNTS

(71) Applicant: Polygroup Macau Limited (BVI), Tortola (VG)

(72) Inventor: Chi Yin Alan Leung, Shenzhen (CN)

(73) Assignee: Polygroup Macau Limited (BVI), Tortola (VG)

( * ) Notice: Subject to any disclaimer, the term of this patent is extended or adjusted under 35 U.S.C. 154(b) by 295 days.

(21) Appl. No.: 14/927,786

(22) Filed: Oct. 30, 2015

(65) Prior Publication Data

US 2016/0123566 A1 May 5, 2016

Related U.S. Application Data

(60) Provisional application No. 62/073,136, filed on Oct. 31, 2014.

(51) Int. Cl.

| | |
|---|---|
| ***F21S 4/10*** | (2016.01) |
| ***F21V 23/00*** | (2015.01) |
| ***F21V 19/00*** | (2006.01) |
| *F21W 121/00* | (2006.01) |
| *F21Y 101/00* | (2016.01) |
| *F21Y 115/10* | (2016.01) |

(52) U.S. Cl.

CPC ..... *F21V 19/006* (2013.01); *F21S 4/10* (2016.01); *F21V 23/00* (2013.01); *F21W 2121/00* (2013.01); *F21Y 2101/00* (2013.01); *F21Y 2115/10* (2016.08)

(58) Field of Classification Search

CPC ..... F21V 19/006; F21V 23/00; F21S 4/10

See application file for complete search history.

(56) References Cited

U.S. PATENT DOCUMENTS

| | | | | |
|---|---|---|---|---|
| 2,297,258 | A | 9/1942 | Spanner | |
| 3,032,708 | A | 5/1962 | Wise | |
| 3,532,931 | A | 10/1970 | Cote et al. | |
| 4,034,448 | A * | 7/1977 | Magherini | F21S 4/10 445/27 |
| 4,667,481 | A | 5/1987 | Watanabe et al. | |
| 4,727,449 | A | 2/1988 | Fleck | |
| 6,283,797 | B1 * | 9/2001 | Wu | H01J 61/56 439/619 |

(Continued)

FOREIGN PATENT DOCUMENTS

| | | | |
|---|---|---|---|
| CN | 203323058 | U | 12/2012 |
| CN | 203099480 | U | 7/2013 |

(Continued)

*Primary Examiner* — Anh Mai
*Assistant Examiner* — Nathaniel Lee
(74) *Attorney, Agent, or Firm* — Troutman Sanders LLP; Ryan A. Schneider; Christopher C. Close, Jr.

(57) ABSTRACT

Employing capacitors as shunts in a decorative light string can prevent the circuit from being opened when a lamp burns out or becomes loose in the socket. But manually assembling such a light string is costly and the quality of the resulting string is not assured to be high. The present disclosure introduces a shunted light string, and a method of assembling that light string that is able to be automated to ensure a consistent quality level by reducing or eliminating human workmanship issues.

9 Claims, 8 Drawing Sheets

(56) References Cited

U.S. PATENT DOCUMENTS

| | | | | |
|---|---|---|---|---|
| 6,518,707 | B2 | 2/2003 | Gershen et al. | |
| 7,166,968 | B2 | 1/2007 | Janning | |
| 7,391,161 | B2 | 6/2008 | Janning | |
| 7,732,942 | B2 | 6/2010 | Janning | |
| 7,851,981 | B2 | 12/2010 | Altamura | |
| 8,093,819 | B2 | 1/2012 | Tsai | |
| 8,324,820 | B2 * | 12/2012 | Janning | H05B 33/0821 315/185 R |
| 2009/0128042 | A1 | 5/2009 | Janning | |
| 2014/0300286 | A1 * | 10/2014 | Han | H05B 37/00 315/187 |
| 2014/0300287 | A1 * | 10/2014 | Han | F21S 4/001 315/188 |

FOREIGN PATENT DOCUMENTS

| | | | |
|---|---|---|---|
| CN | 203176883 | U | 9/2013 |
| CN | 203202767 | U | 9/2013 |

* cited by examiner

SEASONAL LIGHT STRINGS AND METHOD OF ASSEMBLING SEASONAL LIGHT STRINGS EMPLOYING CAPACITOR SHUNTS

CROSS-REFERENCE TO RELATED APPLICATION AND PRIORITY CLAIM

This application claims the benefit, under 35 U.S.C. § 119(e), of U.S. Provisional Patent Application No. 62/073,136, filed 31 Oct. 2014, entitled "METHOD OF ASSEMBLING SEASONAL LIGHT STRINGS EMPLOYING CAPACITOR SHUNTS," the entire contents and substance of which is incorporated herein by reference in its entirety as if fully set forth below.

BACKGROUND

Field of the Invention

Embodiments of the present invention relate to seasonal light strings and, more particularly, to seasonal light strings employing capacitors as a shunt and methods of assembling the same.

Description of the Related Art

Many different designs for seasonal light strings are known. In the design of traditional seasonal strings, the lamps, either incandescent lamps or light emitting diodes (LEDs), are series connected. If one of the lamps burns out or becomes loose from the socket, the light string circuit will be open and the lights in the series will no longer illuminate.

In order to allow the circuit to remain closed when a bulb burns out or is loose, a device known as a shunt can be employed. An alumina shunt is one example of what has been employed inside a tungsten incandescent bulb so that when a tungsten filament is burnt out or broken after prolonged use, the outer layer of the alumina shunt wire will evaporate and the alumina shunt will start to conduct electric current. The circuit will remain closed and the remaining lamps can still illuminate. One major drawback of an alumina shunt is that it cannot prevent the circuit from being open when a lamp is off the socket.

Additional shunts of different sorts have evolved and are placed across the terminals inside the lamp socket. These components are typically assembled by hand, and thus the process is costly sometimes slow compared to other aspects of light string production.

Accordingly, it would be desirable to have a method of automating or expediting the assembly process of a seasonal light string employing capacitor shunting.

SUMMARY

Owing to the vast supply and low material cost of capacitors, applying capacitors as shunts in a decorative light string is a cost effective means of making an improved decorative light string. However, inserting a capacitor into a lamp socket, in the past, has been a manual procedure performed inefficiently, which can be costly and can induce hidden quality problems. The present invention includes an innovative approach to automate, or expedite and make easier, the tedious assembling procedure of making seasonal light strings employing capacitors as shunts inside each lamp socket. The present invention includes a well controlled process that can help ensure consistent quality and reduce labor cost.

In some embodiments, a light string according to the present disclosure can comprise a plurality of lamp portions.

Each lamp portion can comprise a lamp socket, first and second wire ends positioned within the lamp socket, a capacitor located in the lamp socket, and a lamp sub-assembly located at least partially in the lamp socket. A first lead of the capacitor may be in electrical communication with the first wire end, and a second lead of the capacitor may be in electrical communication with the second wire end. The lamp sub-assembly can comprise a lamp and a lamp housing, with a first lead of a lamp in electrical communication with the first wire end, and a second lead of the lamp in electrical communication with the second wire end. In some embodiments, the lamp portions are in electrical communication with each other, and disposed at intervals along a length of wire.

In some embodiments, the lamps in the light strings can be incandescent bulbs. In some embodiments, the lamps in the light strings can be light emitting diodes. The capacitors in the lamp housings can have a capacitance of about 10 μF to 500 μF and a voltage rating of about 1V to 200V. Some applications can have capacitors can have a capacitance of about 30-1000 μF and a voltage rating of about 12-20V. The capacitors may be of the non-polarized type.

The present disclosure is also directed to a method of assembling a light string, such as the one described above. The method can include several steps that can be done by hand or automated. First, the method can include feeding a one or more wires into a lamp socket. In some embodiments, a length of wire can be cut, resulting in the first end and the second end of the wire. These wire ends may then be stripped, and the ends can be connected to wire terminals by crimping, soldering, twisting, inserting, or splicing. In some embodiments, these wire terminals may then be positioned into slots located on an interior surface of the lamp socket.

Next, the method can include inserting a capacitor into the lamp socket such that a first lead of the capacitor is in electrical communication with a first end of the one or more wires, and a second lead of the capacitor is in electrical communication with a second end of the one or more wires. In some embodiments, the capacitor may be of a type as discussed above.

Finally, the method can include inserting a lamp sub-assembly into the lamp socket such that a first lead of the lamp is in electrical communication with the first end of the wire, and a second lead of the lamp is in electrical communication with the second end of the wire. The lamp sub-assembly can include a lamp and a lamp housing, and may be assembled prior to the assembly of the light string.

Further features of the invention, and the advantages offered thereby, are explained in greater detail hereinafter with reference to specific embodiments illustrated in the accompanying drawings, wherein like elements are indicated by like reference designators.

DETAILED DESCRIPTION

Figure 1:
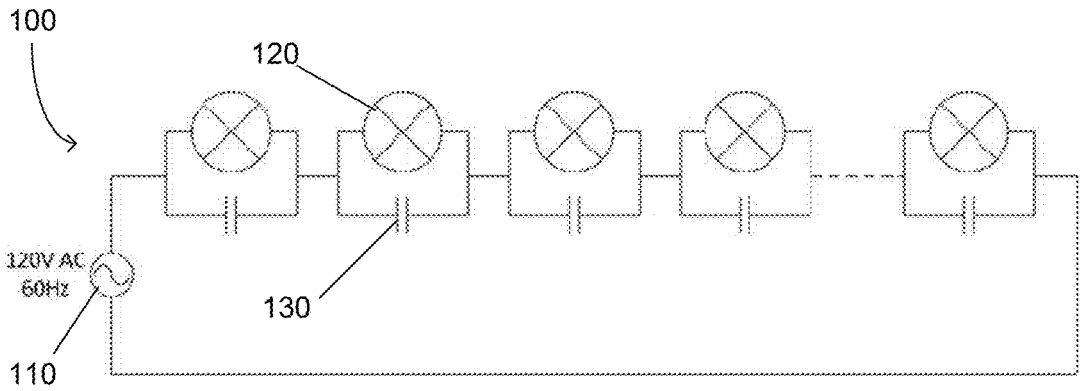
FIG. 1 is a schematic of an electrical circuit of a seasonal light string according to an embodiment of the present disclosure.

To facilitate an understanding of the principles and features of the various embodiments of the invention, various illustrative embodiments are explained below. Although exemplary embodiments of the invention are explained in detail as being systems and methods for assembling seasonal light strings employing a capacitor as a shunt, it is to be understood that other embodiments are contemplated, such as embodiments employing other types of light strings, shunting devices, materials, and the like. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of this disclosure, various illustrative embodiments are explained below. In particular, various embodiments of this disclosure are described as a method for assembling seasonal light strings employing a capacitor as a shunt. Some embodiments of the invention, however, may be applicable to other contexts, and embodiments employing these applications are contemplated. For example and not limitation, some embodiments of the invention may be applicable to various types of light strings and shunting devices as desired.

FIG. 1 illustrates a circuit diagram of an exemplary seasonal light string in accordance with the present disclosure. Circuit 100 can include an electrical source 110 that provides, for example and not limitation, 120V of alternating current at 60 Hz. In some embodiments according to the present disclosure, source 110 is a standard home electrical outlet. Source 110 could also be a direct current source in the case of a battery operated light string or device.

Circuit 100 can further include a series of lamps 120. In some embodiments according to the present disclosure, lamps 120 are incandescent light bulbs. Alternatively or in combination, lamps 120 can be light emitting diodes (LEDs). As FIG. 1 illustrates, circuit 100 can include capacitors 130 connected in parallel to lamps 120. In some embodiments according to the present disclosure, each lamp 120 can have a capacitor 130 connected in parallel, and each pairing of lamp 120 and capacitor 130 can be connected in series.

In order to select an appropriate capacitor, several factors can be considered. In order for the capacitor to properly shunt a circuit, an appropriate capacitance should be selected. To ensure that the capacitor does not over heat and produce an unsafe condition, a capacitor having an appropriately high voltage rating should be selected. Due to the size of a typical lamp in a light string, sizing of the capacitor also should be considered. Relatedly, due to the potentially high number of lamps in a decorative light string, cost can also be a consideration in capacitor selection. For example and not limitation, capacitor 130 can be selected to have a capacitance of 1 μF to 500 μF and a voltage rating of 1V to 200V. In an exemplary embodiment of the present disclosure, the capacitor is selected to have a rating of 47-100 μF and 16V, and may be of the non-polarized type. By way of example and not limitation, an embodiment may include a 68 μF, 16V non-polarized capacitor having dimensions of approximately 5 mm by 8 mm.

Figure 2:
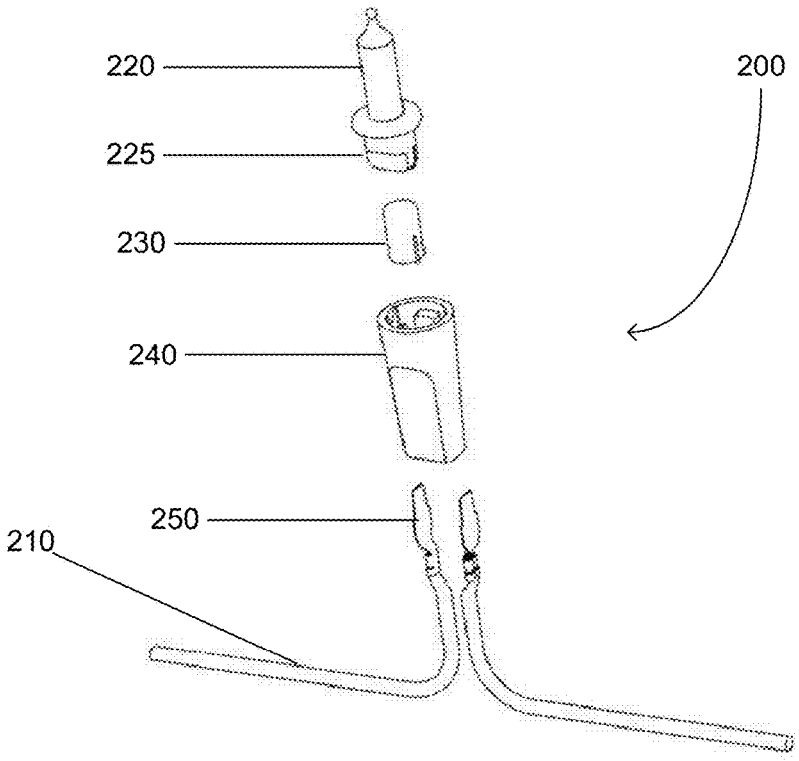
FIG. 2 is an exploded view of a single bulb portion in accordance with an exemplary embodiment of the present disclosure.
Figure 3:
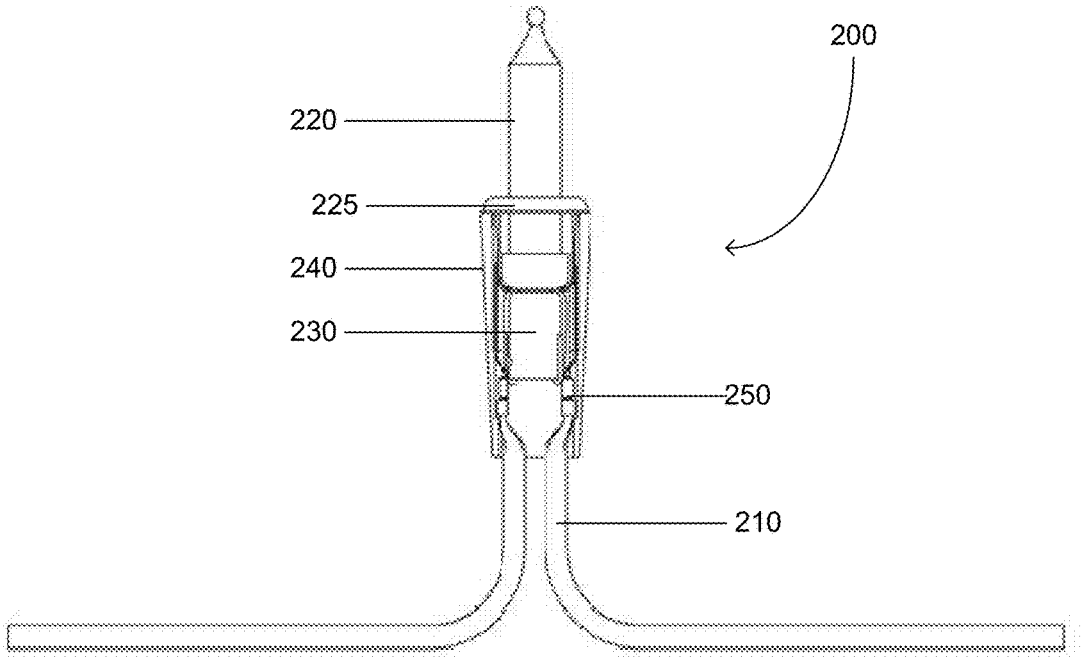
FIG. 3 is a cross-sectional view of an assembled single bulb portion in accordance with an exemplary embodiment of the present disclosure.

FIG. 2 depicts an exploded view of a single bulb portion 200. In the embodiment shown in FIG. 2, each lamp portion 200 is located along wire 210. Each lamp portion can include a lamp 220, lamp housing 225, capacitor 230, lamp socket 240, and terminals 250. FIG. 3 shows a cross-section of the components of lamp portion 200 in a fully assembled state. In some embodiments, a shoulder portion of lamp housing 225 abuts lamp socket 240 and secures lamp 220 therein.

Figure 4:
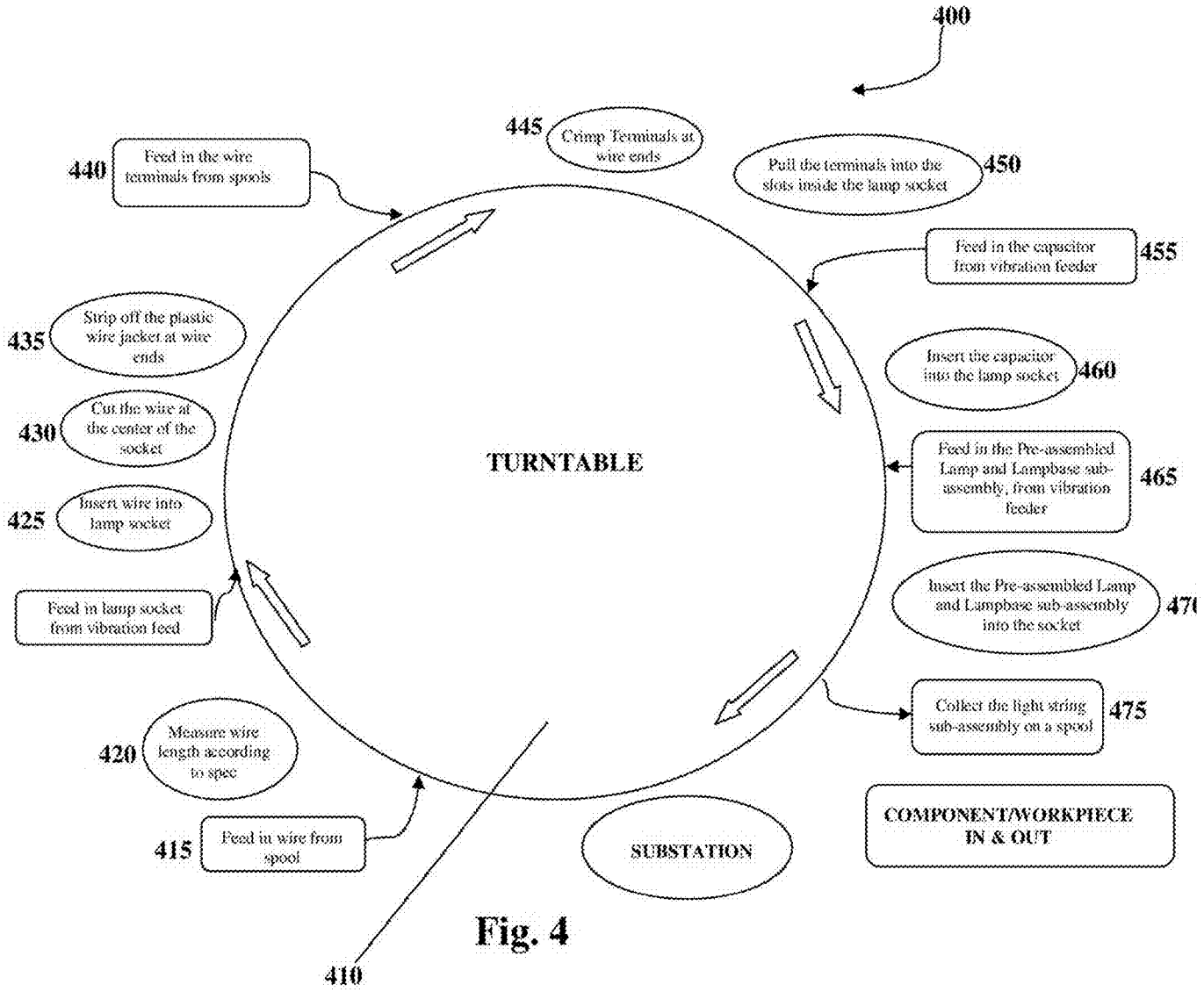
FIG. 4 is a schematic process overview showing the material inputs and assembly steps around a turntable according to a method in accordance with the present disclosure.

An exemplary method 400 of producing a seasonal light string is represented in FIG. 4. FIG. 4 shows the steps to be performed at each location around turntable 410. The method 400 may be performed by any number of devices or machines, with or without human assistance. In some embodiments, all of the method steps are performed automatically. However, it is contemplated that none or not all of the method steps are automated.

Turntable 410 can be one of many different types of workstations. Due to the selection of components and the particulars of the process steps, turntable 410 may be a fully automated machine. In some embodiments, turntable 410 is a self-powered rotating table. Some embodiments may require or allow for human intervention in the process of advancing the light string along or around turntable 410. In some embodiments, turntable 410 can be a linear conveyor belt or work station. The steps of a method according to the present disclosure may be performed at various locations along or around turntable 410, or they could be performed at a single location while the necessary components are provided to the single location.

Figure 5:
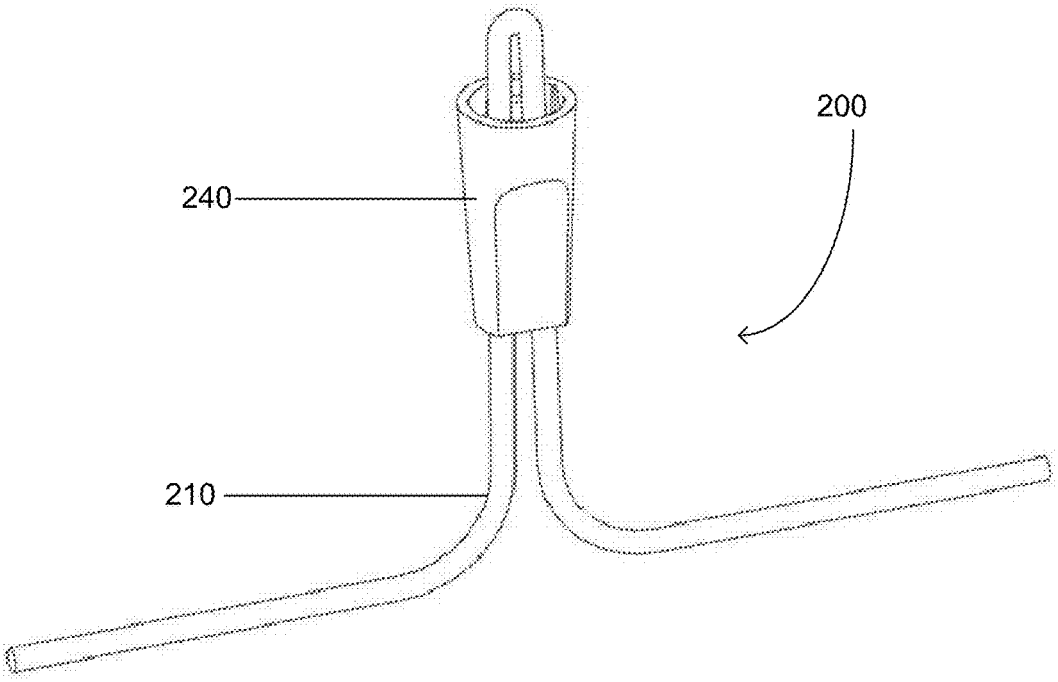
FIG. 5 is a perspective view of a single bulb portion at the first step of seasonal light string assembly, in accordance with the present disclosure.
Figure 6:
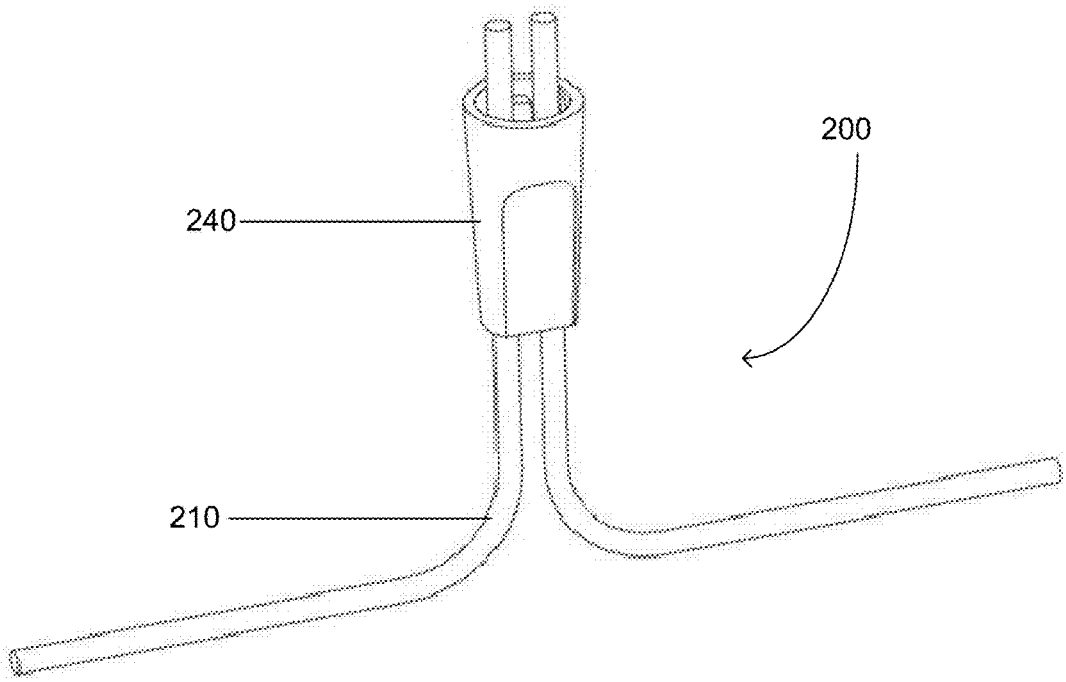
FIG. 6 is a perspective view of a single bulb portion at the second step of seasonal light string assembly, in accordance with the present disclosure.
Figure 7:
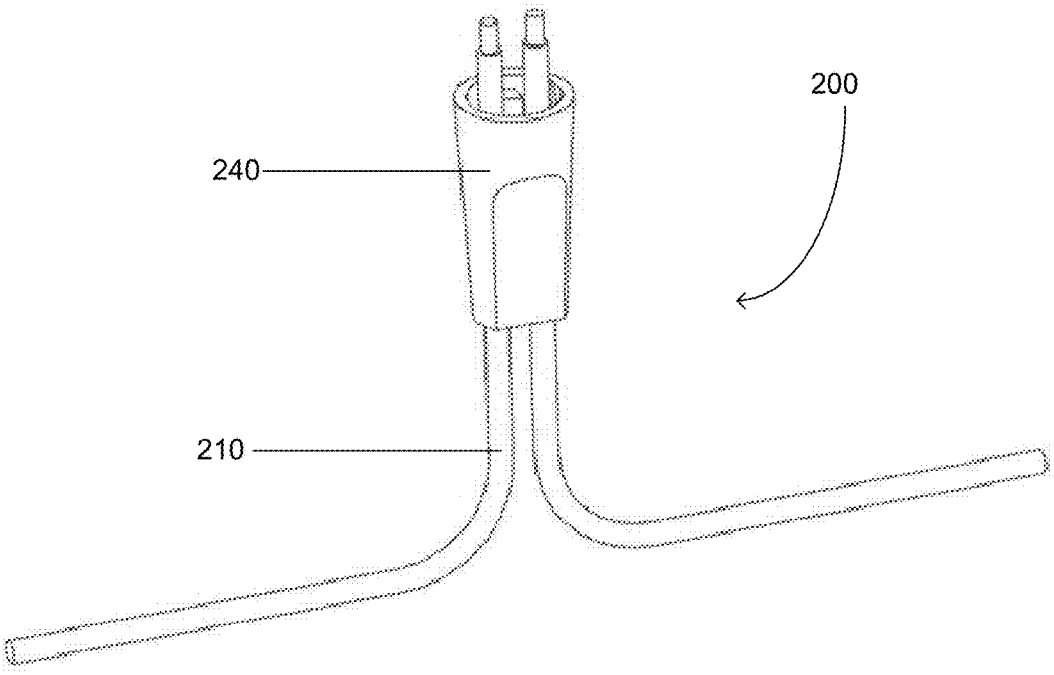
FIG. 7 is a perspective view of a single bulb portion at the third step of seasonal light string assembly, in accordance with the present disclosure.

Step 415 involves having wire 210 fed into the turntable from a spool. The wire is then measured according to the specification for the particular seasonal light string to be produced, and the lamp sockets 240 are positioned appropriately (steps 420 and 425). The result of step 425 is illustrated in FIG. 5. The wire 210 is then cut (step 430), and FIG. 6 shows the lamp portion 200 and the wire 210 afterwards. Once wire 210 has been cut, the cut ends of wire 210 are stripped and prepared for further assembly (step 435). The cut and stripped ends of wire 210 are shown in FIG. 7. In some embodiments, the cutting and stripping can be done in advance of positioning the lamp sockets.

Figure 8:
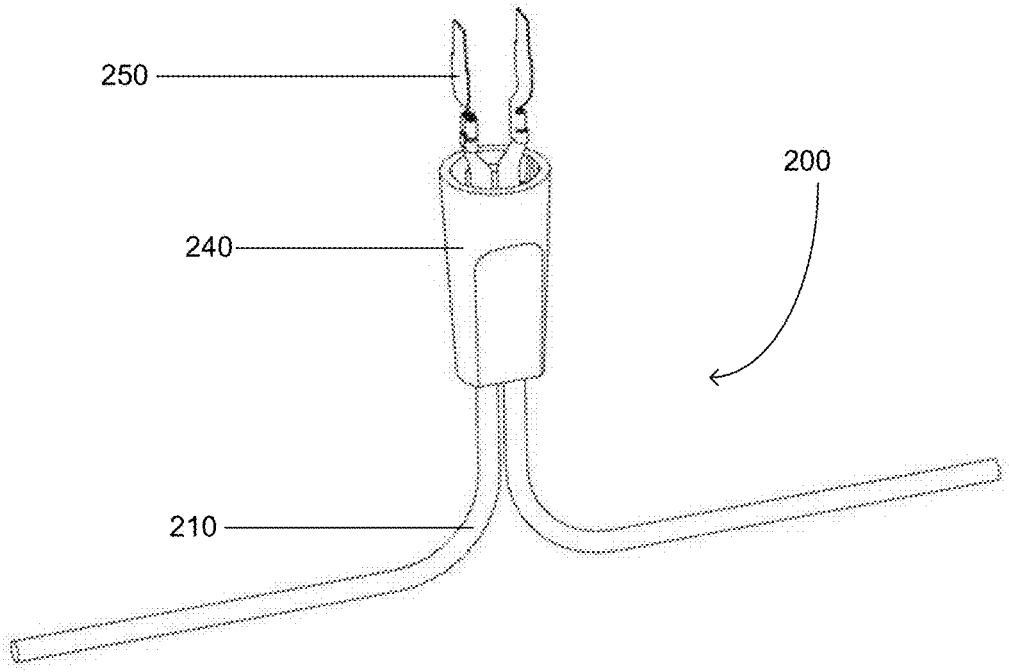
FIG. 8 is a perspective view of a single bulb portion at the fourth step of seasonal light string assembly, in accordance with the present disclosure.
Figure 9:
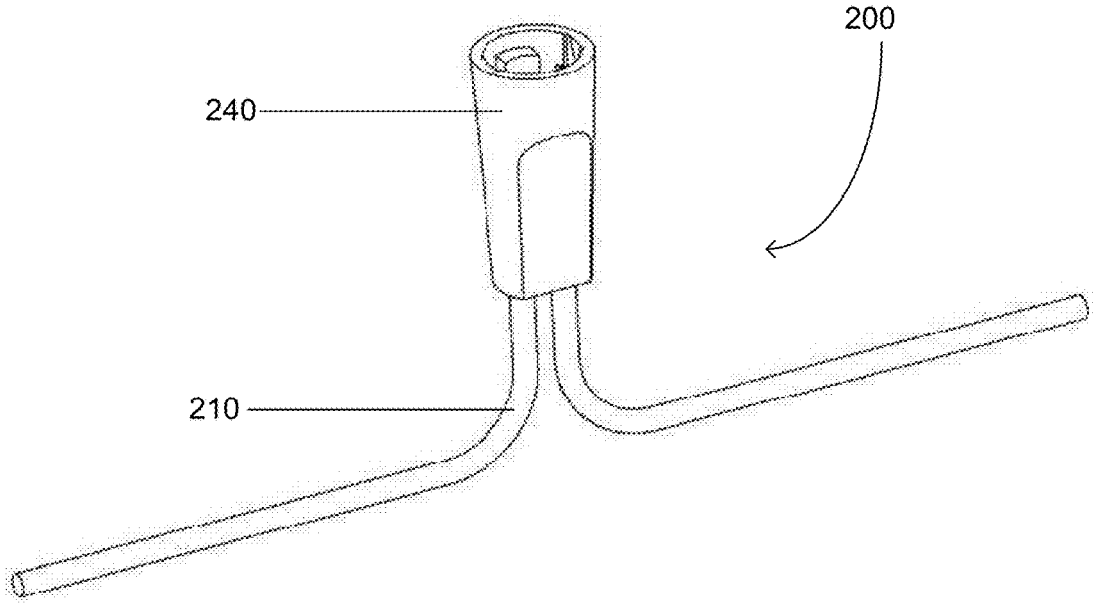
FIG. 9 is a perspective view of a single bulb portion at the fifth step of seasonal light string assembly, in accordance with the present disclosure.
Figure 10:
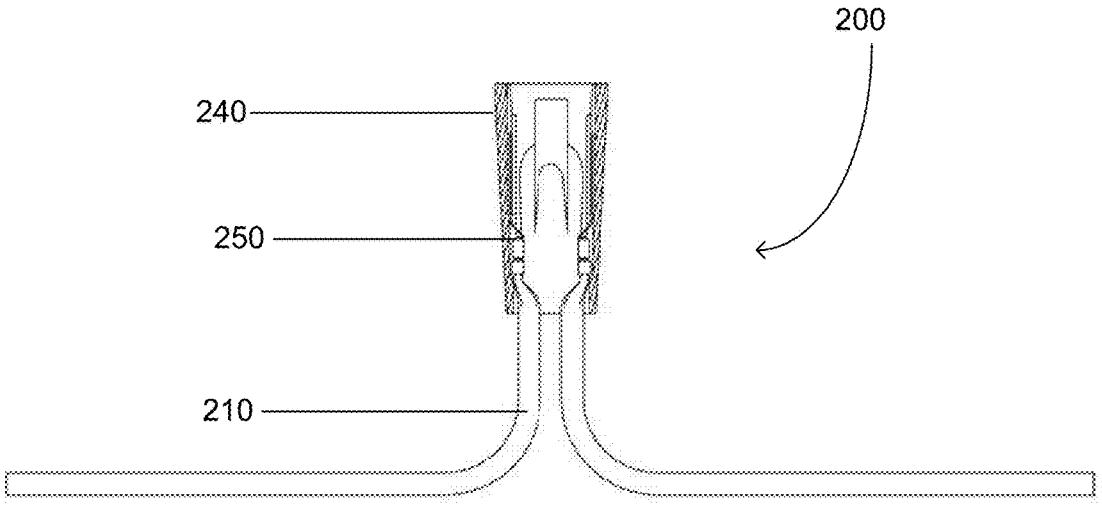
FIG. 10 is a cross-sectional view of a single bulb portion at the fifth step of seasonal light string assembly, in accordance with the present disclosure.

At this point along turntable 410, terminals 250 may be fed to the wire 210 (step 440), and then they are attached to the cut ends of the wire 210 (step 445). In some embodiments the terminals are attached to the cut ends of the wire by crimping, soldering, twisting, inserting, and/or splicing. FIG. 8 illustrates lamp portion 200 once terminals 250 have been attached to the wire 210. The terminals 250 are then pulled into lamp socket 240 such that they seat in slots located on either side of the socket (step 450). FIG. 9 shows the outside view of lamp portion 200 with terminals 250 seated within lamp socket 240, and FIG. 10 shows a cross-sectional view of the assembly in FIG. 9.

Figure 11:
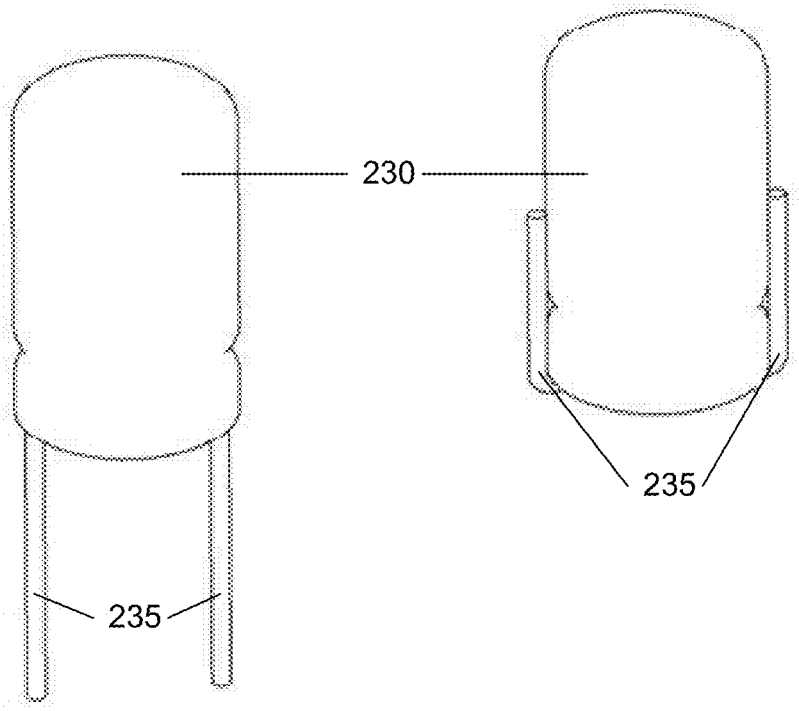
FIG. 11 is a perspective view of a capacitor to be installed in the seasonal light string assembly, in accordance with the present disclosure.
Figure 12:
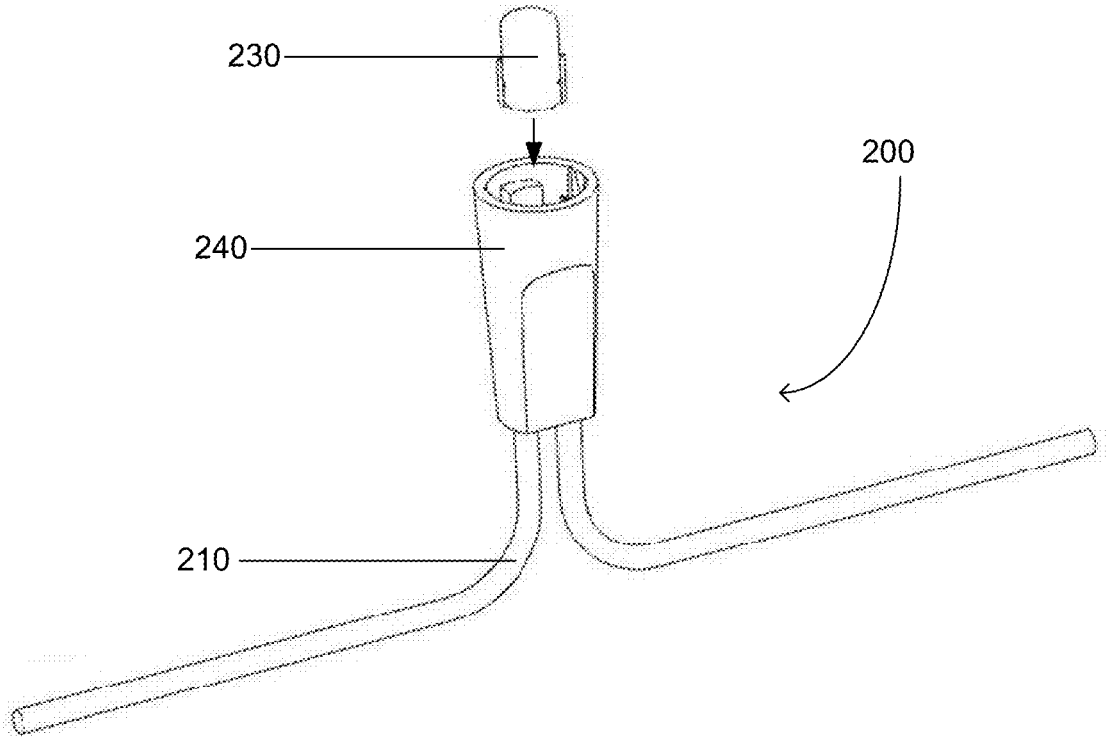
FIG. 12 is a perspective view of a single bulb portion and capacitor at the sixth step of seasonal light string assembly, in accordance with the present disclosure.

Step 455 provides that capacitors 230 are fed to turntable 410. In some embodiments, this is done by a vibration feeder or other type of feed system known in the art. The capacitor in its original and its ready-to-install states are illustrated in FIG. 11. Capacitor 230 has two leads 235 that are manipulated such that they go from projecting downward and away from capacitor 230 to a ready-to-install state wherein leads 235 project upward and along the sides of capacitor 230. This manipulation may be done either before or after being fed to turntable 410 in any number of ways known in the art such as by hand or by mechanical process. Once capacitors 430 are in their ready-to-install state and have been fed to turntable 410, they can be inserted into lamp socket 240 as seen in FIG. 12 (step 460). Once inserted, leads 235 will be in electrical communication with terminals 250.

Figure 13:
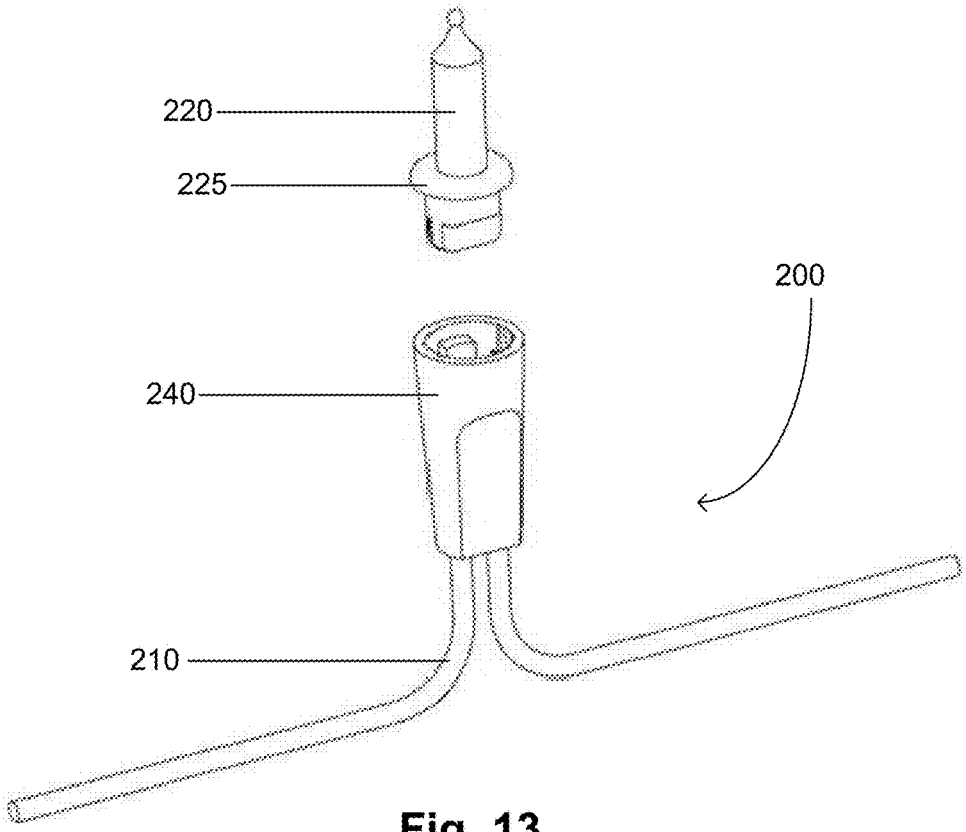
FIG. 13 is a perspective view of a single bulb portion at the seventh step of seasonal light string assembly, in accordance with the present disclosure.
Figure 14:
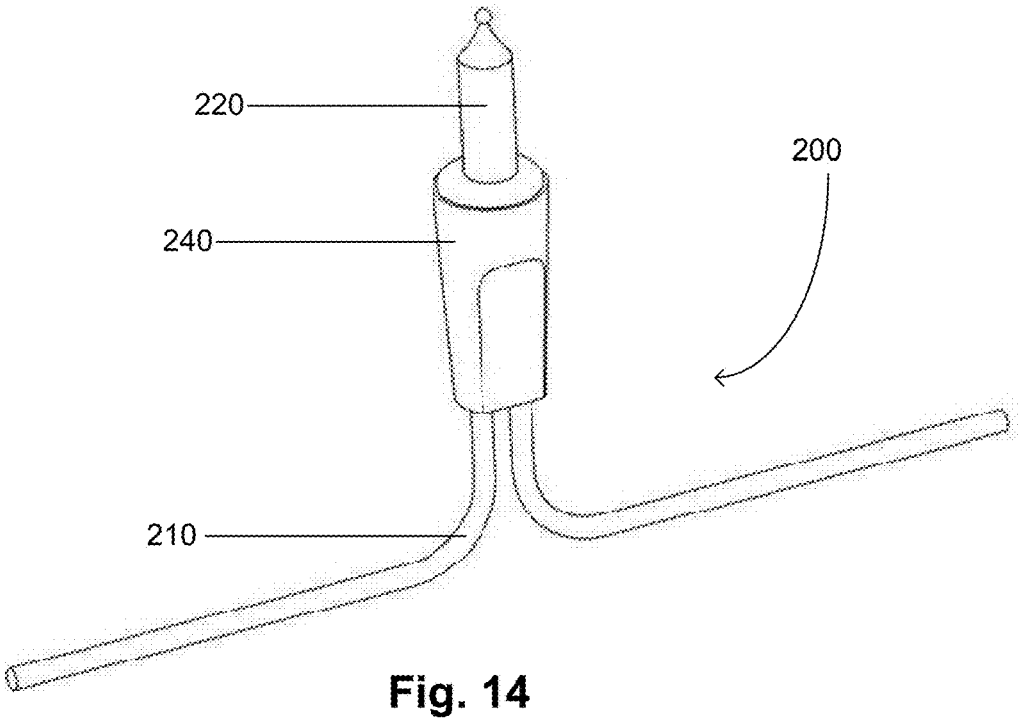
FIG. 14 is a perspective view of a single bulb portion after it has been assembled in accordance with the present disclosure.

At step 465 around turntable 410, pre-assembled lamp sub assemblies are fed into the system. Each lamp sub assembly has a lamp 220 and lamp housing 225. FIG. 13 illustrates the lamp 220 and lamp housing 225 assembled and ready to be installed into lamp socket 240. FIG. 14 depicts the completed lamp portion 200, after the lamp has been inserted (step 470). Once all of the components of each lamp portion 200 of the light string have been properly assembled, the light string is finished (other components are added, such as plugs at the end of the light strings) and passed from turntable 410 to a spool to be stored and/or prepared for packaging and shipping (step 475).

From the foregoing, it can be seen that the invention provides a method of production, which can be used to produce capacitor-shunted light strings. It will be appreciated by those skilled in the art, however, that the invention can be embodied in other specific forms without departing from the spirit or essential characteristics thereof. For example, while the invention has been described in the context of a capacitor-shunted seasonal light string, the concepts described herein need not be limited to this illustrative embodiment. For example, light strings having different shunting devices can be constructed using the same or similar method, and would enjoy the same benefits as described above. Additionally, the specific configurations, choice of materials, and the size and shape of various elements, including the lamps and sockets, could be varied according to particular design specifications or constraints requiring a seasonal light string or decoration to meet additional of different design parameters. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A method of assembling a light string; the method comprising:

inserting a wire into a lamp socket;

cutting the wire to provide a first end and a second end of the wire;

stripping wire insulation from the first and second ends of the wire;

connecting a first wire terminal to the first end of the wire and a second wire terminal to the second end of the wire;

inserting a capacitor into the lamp socket such that a first lead of the capacitor is in electrical communication with the first end of the wire, and a second lead of the capacitor is in electrical communication with the second end of the wire; and inserting a lamp sub-assembly into the lamp socket such that a first lead of the lamp is in electrical communication with the first end of the wire, and a second lead of the lamp is in electrical communication with the second end of the wire.

2. The method of claim 1, wherein the step of connecting the wire terminals further comprises positioning the first wire terminal into a first slot located on an interior surface of the lamp socket, and the second wire terminal into a second slot located on the interior surface of the lamp socket.

3. The method of claim 1, wherein the step of connecting the wire terminals to the first and second ends of the wire is accomplished by one of more of crimping, soldering, twisting, inserting, and splicing.

4. The method of claim 1, wherein the capacitor has a capacitance of about 1 μF to 500 μF and a voltage rating of about 1V to 200V.

5. The method of claim 1, wherein the capacitor is a non-polarized capacitor.

6. The method of claim 1, wherein the lamp sub-assembly comprises a lamp and a lamp housing.

7. The method of claim 6, wherein the lamp is an incandescent light bulb.

8. The method of claim 6, wherein the lamp is a light emitting diode.

9. A method of assembling a light string at an assembly station; the method comprising:

providing a wire;

feeding the wire into a lamp socket;

cutting the wire;

stripping a first and a second end of the wire;

connecting a first wire terminal to the first end of the wire, and a second wire terminal to the second end of the wire;

positioning the first wire terminal into a first slot located on an interior surface of the lamp socket, and the second wire terminal into a second slot located on the interior surface of the lamp socket;

inserting a capacitor into the lamp socket such that a first lead of the capacitor is in electrical communication with the first end of the wire, and a second lead of the capacitor is in electrical communication with the second end of the wire;

providing a lamp sub-assembly, comprising a lamp having a first and a second lead and a lamp housing; and inserting the lamp sub-assembly into the lamp socket such that the first lead of the lamp is in electrical communication with the first end of the wire, and the second lead of the lamp is in electrical communication with the second end of the wire.

* * * * *